US006019466A

United States Patent [19]

Hermanson

[11] Patent Number: 6,019,466

[45] Date of Patent: Feb. 1, 2000

[54] MULTICOLOR LIQUID INK PRINTER AND METHOD FOR PRINTING ON PLAIN PAPER

[75] Inventor: Herman A. Hermanson, Penfield, N.Y.

[73] Assignee: Xerox Corporation, Stamford, Conn.

[21] Appl. No.: 09/016,886

[22] Filed: Feb. 2, 1998

[51] Int. Cl.[7] ..... B41J 2/01

[52] U.S. Cl. ..... 347/104; 347/102

[58] Field of Search ..... 400/55, 642, 623, 400/630, 631, 632, 645.3; 271/236, 273, 272; 347/101, 104, 105, 102, 8

[56] References Cited

U.S. PATENT DOCUMENTS

| | | | |
|---|---|---|---|
| 4,463,359 | 7/1984 | Ayata et al. | 346/1.1 |
| 4,748,453 | 5/1988 | Lin et al. | 346/1.1 |
| 4,821,049 | 4/1989 | Eckl | 346/134 |
| 5,317,127 | 5/1994 | Brewester, Jr. et al. | 347/102 |
| 5,570,118 | 10/1996 | Rezanka et al. | 347/43 |
| 5,821,968 | 10/1998 | Ohyama et al. | 347/104 |
| 5,859,653 | 1/1999 | Aoki et al. | 347/8 |
| 5,896,143 | 4/1999 | Matsui et al. | 347/35 |

*Primary Examiner*—John Barlow
*Assistant Examiner*—Michael S. Brooke
*Attorney, Agent, or Firm*—Tallam I. Nguti

[57] ABSTRACT

A multicolor liquid ink printer for printing unmottled, high quality images on sheets of plain paper. The multicolor liquid ink printer includes a flat, generally rectangular stationary platen having a first long side, a second long side, a first short end, a second short end, and a sheet supporting surface for supporting a sheet of plain paper. The multicolor liquid ink printer also includes a heating device for heating the stationary platen, and a sheet containing and feeding assembly for containing and feeding sheets of plain paper onto the sheet supporting surface of the stationary platen. Importantly, the multicolor liquid ink printer includes a bidirectionally movable sheet driving and printing assembly that is movable over and relative to the stationary platen and to a sheet being supported on the stationary platen. The sheet driving and printing assembly includes (i) a carriage; (ii) drive rollers mounted to the carriage for driving and moving a sheet on the stationary platen relative to the stationary platen, and (iii) a plurality of full width array printheads mounted to the carriage. Each full width array printhead of the plurality of full width array printheads contains a different color liquid ink for printing an unmottled, high quality liquid ink image onto a sheet of plain paper that is stationarily supported on the flat platen, thereby together forming an unmottled, high quality multicolor liquid ink image on the plain paper.

15 Claims, 3 Drawing Sheets

MULTICOLOR LIQUID INK PRINTER AND METHOD FOR PRINTING ON PLAIN PAPER

BACKGROUND OF THE INVENTION

This invention relates to liquid ink printing, and is more particularly concerned with a multicolor liquid ink printer for producing unmottled, high quality multicolor liquid ink images on plain paper.

In existing thermal ink jet printing, the printhead typically comprises one or more ink ejectors, such as disclosed in U.S. Pat. No. 4,463,359, each ejector including a channel communicating with an ink supply chamber, or manifold, at one end and having an opening at the opposite end, referred to as a nozzle. A thermal energy generator, usually a resistor, is located in each of the channels, a predetermined distance from the nozzles. The resistors are individually addressed with a current pulse to momentarily vaporize the ink and form a bubble which expels an ink droplet. As the bubble grows, the ink rapidly bulges from the nozzle and is momentarily contained by the surface tension of the ink as a meniscus. As the bubble begins to collapse, the ink still in the channel between the nozzle and bubble starts to move towards the collapsing bubble, causing a volumetric contraction of the ink at the nozzle and resulting in the separation of the bulging ink as a droplet.

The acceleration of the ink out of the nozzle while the bubble is growing provides the momentum and velocity of the droplet in a substantially straight line direction towards a print sheet, such as a sheet of paper. Because the droplet of ink is emitted only when the resistor is actuated, this type of thermal ink-jet printing is known as "drop-on-demand" printing. Other types of ink-jet printing, such as piezoelectric, continuous-stream, or acoustic, are also known, and are also applicable to the present invention.

In a single-color ink jet printing apparatus, the printhead typically comprises a linear array of ejectors, and the printhead is moved relative to the surface of the print sheet, either by moving the print sheet relative to a stationary printhead, or vice-versa, or both. In some types of apparatus, a relatively small printhead moves across a print sheet numerous times in swaths, much like a typewriter; alternatively, a printhead which consists of an array of ejectors and extends the full width of the print sheet may be passed once down the print sheet to give full-page images, in what is known as a "full-width array" (FWA) printer. When the printhead and the print sheet are moved relative to each other, imagewise digital data is used to selectively activate the thermal energy generators in the printhead over time so that the desired image will be created on the print sheet.

With ink-jet printing, it is also possible to create multicolor images on a print sheet. This type of printing may be used for full-color images, such as to reproduce a color photograph, or can be employed for "highlight" color, in which colored additions are made to a main portion of the image or text, which is typically black. In either case, the most common technique for color ink jet printing has been to sequentially image two or more colors, in separate printing steps, onto the single print sheet. This superimposition can be carried out in any number of ways. To take the example of a full-width apparatus printing black and one highlight color, an apparatus may print out the entire black portion of the desired highlight image on the sheet, and then recirculate the print sheet once again to image the highlight color portion of the image onto the same sheet from another printhead loaded with the colored ink; such a system has a serious disadvantage in the production of accurate registration of the composed images.

Alternately, two printheads may be positioned very close to each other, and render the two portions of the image onto the print sheet almost simultaneously, although two different areas of the print sheet will be printed upon by the different printheads at the same time or with a small time lag. For a full-color process image, four types of ink (yellow, magenta, cyan, and black) are emitted from four separate printheads during printing as the print sheet is moved relative to them.

In any ink-jet printing apparatus, but particularly in color-printing applications, one key concern is the rapid and efficient drying of the ink which has been placed on the print sheet by the printheads. If wet ink is allowed to remain on the print sheet for an appreciable length of time, the image is likely to smear as the print sheet continues on its path through the apparatus. In color ink jet printing situations, another important problem related to ink drying is known as "intercolor bleed." This is a bleeding of one color portion of the image into another portion of the neighboring image of different color. This becomes most apparent when a black image is imaged immediately adjacent to an area printed with a color such as cyan, magenta, or yellow. In such a case, the black ink will be seen to bleed into the color area (e.g., cyan, magenta, and yellow) to create a conspicuous print defect. If a composite color is made in the color area (e.g. by combining cyan and magenta to make a shade of blue), the problem will be particularly acute because of the large amount of liquid on the sheet surface. The lighter colored ink will bleed into the black portions of the image as well, but bleeding in this direction will not be as noticeable.

Heat and delay printing has been identified as a key technique for achieving high quality color liquid ink printing on plain paper. This is usually demonstrated by printing a slow dry black which yields low MFLEN values (sharp edges) onto a heated paper. Then after approximately one second delay, a fast dry color ink is printed. While printing on the heated paper may not improve the black MFLEN, it will significantly prevent the black ink from bleeding into the color inks (intercolor bleed).

Although the fast dry color printing has some feathering, the black printing creates the impression of a sharp printed result. When printing solid areas with a slow dry black ink on a heated substrate, a mottled print often results. This can be reduced by checkerboard printing techniques which allow small printed areas to dry prior to spreading. Checkerboard printing also minimizes print curl and if the printhead is shifted lengthwise between the two printing cycles, printhead signature and/or defects are also minimized.

To reduce the print defects caused by inefficient drying of ink on the substrate and by intercolor bleed, it is however well known to use special but expensive coated sheets or paper as opposed to plain or uncoated paper which ordinarily result in very poor quality images. Additionally, "quick penetrating" inks or special printing techniques such as checkerboard printing disclosed for example in U.S. Pat. No. 4,748,453 issued to Lin et al, and heat and delay printing disclosed for example in U.S. Pat. No. 5,570,118 issued to Rezanka et al., must be used. Attempts to use such quick-penetrating inks to similarly print liquid ink images on plain paper ordinarily result in poor quality images having a defect such as "mottle".

There is therefore still a need to provide an ink-jet color printing apparatus having an architecture and including printhead structures and electronic control subsystems for producing unmottled, high quality multicolor liquid images on plain paper.

SUMMARY OF THE INVENTION

In accordance with the present invention, there is provided a multicolor liquid ink printer for printing unmottled, high quality images on sheets of plain paper. The multicolor liquid ink printer includes a flat, generally rectangular stationary platen having a first long side, a second long side, a first short end, a second short end, and a sheet supporting surface for supporting a sheet of plain paper. The multicolor liquid ink printer also includes a heating device for heating the stationary platen, and a sheet containing and feeding assembly for containing and feeding sheets of plain paper onto the sheet supporting surface of the stationary platen. Importantly, the multicolor liquid ink printer includes a bidirectionally movable sheet driving and printing assembly that is movable over and relative to the stationary platen and to a sheet being supported on the stationary platen. The sheet driving and printing assembly includes (i) a carriage; (ii) drive rollers mounted to the carriage for driving and moving a sheet on the stationary platen relative to the stationary platen, and (iii) a plurality of full width array printheads mounted to the carriage. Each full width array printhead of the plurality of full width array printheads contains a different color liquid ink for printing an unmottled, high quality liquid ink image onto a sheet of plain paper that is stationarily supported on the flat platen, thereby together forming an unmottled, high quality multicolor liquid ink image on the plain paper.

BRIEF DESCRIPTION OF THE DRAWINGS

In the detailed description of the invention presented below, reference is made to the drawings, in which.

DETAILED DESCRIPTION OF THE INVENTION

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

Figure 1:
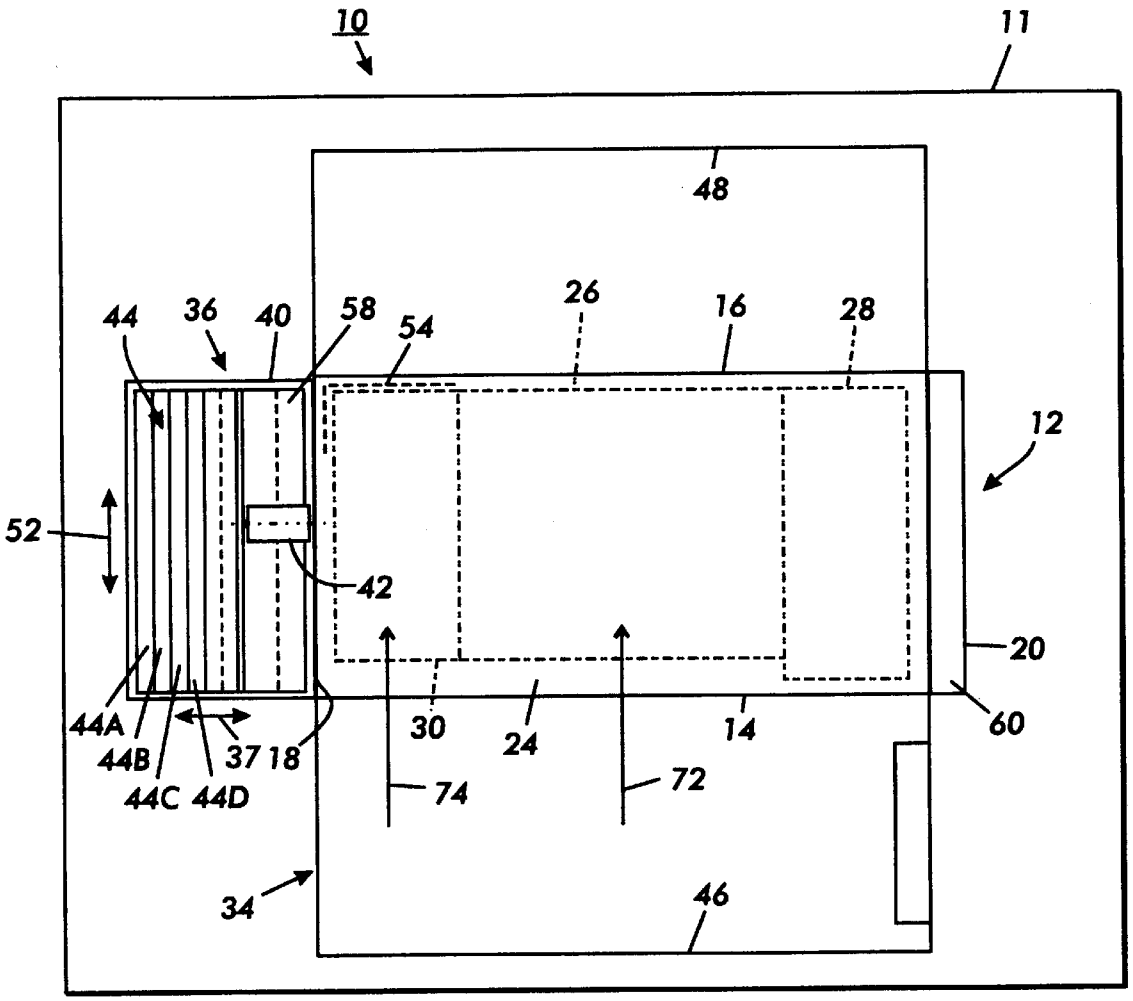
FIG. 1 is a top view schematic of a first embodiment of an ink jet printing apparatus for printing unmottled, high quality liquid ink images in accordance with the present invention.
Figure 2:
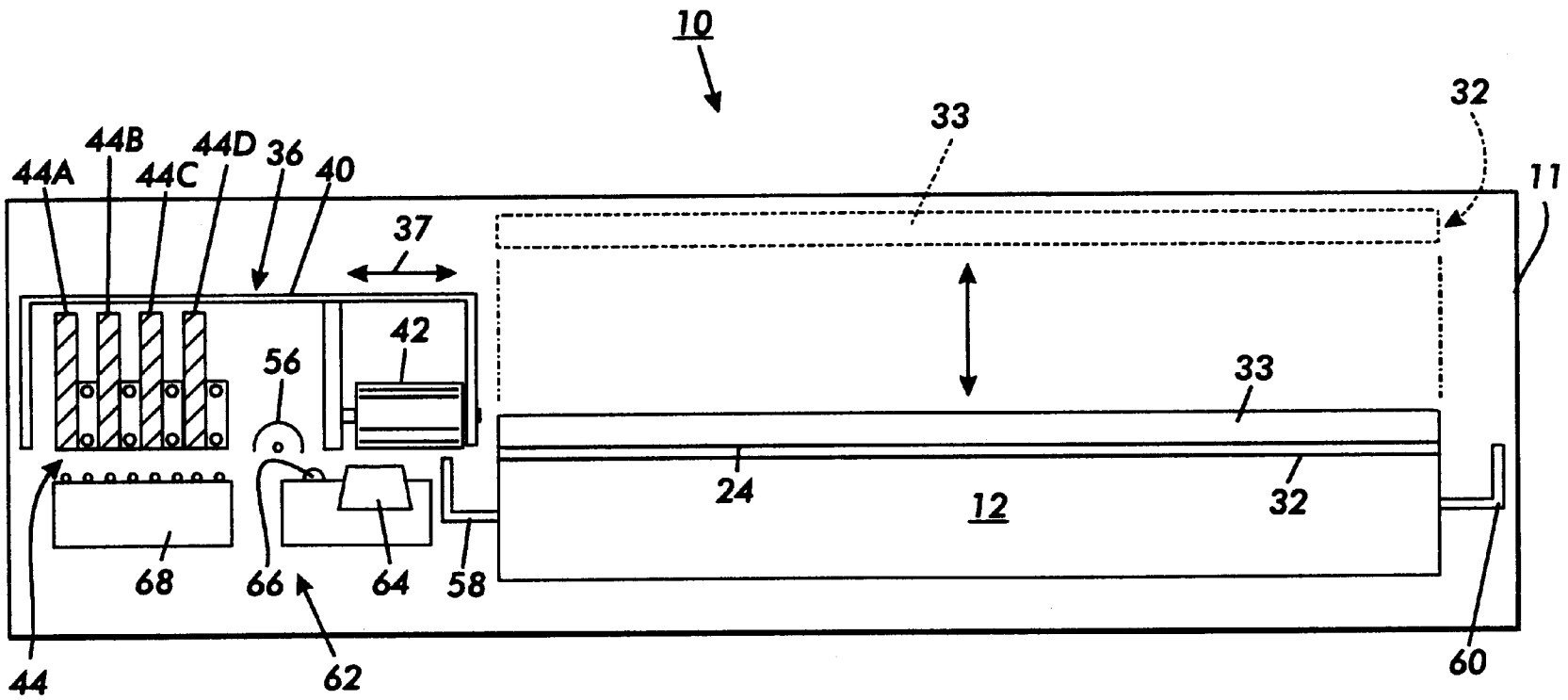
FIG. 2 is a vertical side schematic of the printing apparatus of FIG. 1.

Referring now to FIGS. 1 and 2, the liquid ink printing apparatus or printer of the present invention is a multicolor liquid ink printer illustrated generally as 10. As shown, the multicolor liquid ink printer 10 includes a frame 11, and an electrically and thermally insulated flat, and generally rectangular stationary platen 12. The platen 12 has a first long side 14, a second long side 16, a first short end 18, a second short end 20, and a substrate supporting surface 24 for supporting various sizes of sheets for example plain paper sheets 26, and 28, as well as envelopes 30. The envelopes 30 or sheets 26, 28 are fed by a suitable feedhead (not shown) in the direction of the arrows 72, 74, onto the supporting surface 24. The heated platen 12 is preferably made of anodized aluminum, and is low mass, and thermally well insulated. As shown, the platen 12 includes a heating device 32 (FIG. 2) for heating the stationary platen 12. The heating device 32 preferably is a linear foil heater is located within the platen 12, and just below the substrate supporting surface 24, for providing uniform heat to the surface 24. The heated platen 12 is insulated electrically in order to enable the use of low noise electrostatic charging for holding down the substrate (sheets 26, 28, or envelopes 30) thereonto.

As further shown, the multicolor liquid ink printer 10 includes a flexible heat insulating shield 33 for covering and insulating the heated substrate supporting surface 24 of the platen during an idle period between printing operations. The heat insulating shield 33 preferably is mounted movably over the stationary platen 12, and is movable towards and away from the substrate supporting surface 24 of the platen. Further, during running periods, this shield 33 preferably also tips upwards for jam clearance.

The multicolor liquid ink printer 10 also includes a sheet containing and feeding assembly 34 for containing and feeding sheets of plain paper onto the sheet supporting surface 24 of the stationary platen. In the first embodiment of FIGS. 1 and 2, the sheet containing and feeding assembly 34 includes a sheet containing tray 46, and a feed head (not shown), mounted to the first long side 14 of the stationary platen, for feeding sheets long edge first onto the platen. Preferably, the sheet containing tray 46 is a 500 (sheet capacity) input trays for feeding sheets long edge first as shown. The multicolor liquid ink printer 10 also includes an output 48 located such that the input and output trays 46, 48 provide a straight, short paper path that enables convenient handling of envelopes, transparencies and heavy cardstock.

Importantly, the multicolor liquid ink printer 10 further includes a bidirectionally movable sheet driving and printing assembly 36 that is movable over and relative to the stationary platen 12, as well as to a sheet 26, 28, or envelope 30, being supported on the stationary platen. The bidirectionally movable sheet driving and printing assembly 36 is mounted within the liquid ink printer suitably for moving back and forth as shown by the arrow 37 between the first short end 18 and the second short end 20 of the stationary platen 12.

As illustrated, the sheet driving and printing assembly 36 includes (i) a carriage device 40; (ii) drive rollers 42 mounted to the carriage device for driving and moving a sheet 26, 28, or envelope 30, onto and off the stationary platen, and (iii) a plurality 44 of full width array printheads shown as 44A, 44B, 44C and 44D that are mounted to the carriage device 40. Each full width array printhead 44A, 44B, 44C and 44D of the plurality 44 of full width array printheads contains a different color liquid ink for printing an unmottled, high quality liquid ink image onto a sheet 26, 28 of plain paper, or envelope 30, that is stationarily supported on the flat platen 12. As such, they all cooperate in forming an unmottled, high quality multicolor liquid ink image on the envelope or sheet of plain paper.

Each full width array printhead 44A–44D has a long axis, and as shown by the arrow 52, each is shiftable along its long axis for preventing printhead signature defects in a printed image. The printheads 44A–44D are each approximately 9" long in order to enable full page width printing even given the lateral shift for minimizing printhead signature defects. The multicolor liquid ink printer 10 also includes an articulating sheet registration guide 54 mounted at one corner of the stationary platen 12 between a long side and a short end adjoining the long side, of the stationary platen.

The movable carriage device 40 thus serves many uses. It carries the sheet drive or transport rollers 42, the four full width printheads 44A–44D, and the charging device 56, which can be a corotron or brush carging element. The charging device 56 selectively produces electrostatic charge onto the sheet for electrostatically holding or tacking it down onto the sheet supporting surface 24. The charging device 56 is mounted to the carriage of the sheet driving and printing assembly 36 for moving therewith relative to the stationary platen 12, and relative to a sheet of paper on the stationary platen.

As also shown, the multicolor liquid ink printer 10 includes a first spit station 58 at the first short end 18, and a second spit station 60 at the secured short end 20, for purging each full width array printhead 44A–44D between successive printing movements of the bidirectionally movable sheet driving and printing assembly 36 from one short end to the other.

The multicolor liquid ink printer 10 further includes a maintenance station 62 located at the first short end 18 of the stationary platen for maintaining each full width array printhead 44A–44D. As shown, the maintenance station includes a wet wiper member 64 for applying a wetting liquid to nozzles of each full width array printhead 44A–44D, a vacuum priming device for applying a vacuum suction force to wetted nozzles of each full width array printhead, and a capping member 68 for capping nozzles of each full width array printhead during long idle periods of the printer 10.

The multicolor liquid ink printer 10 preferably also includes an exhaust fan (not shown) mounted adjacent the sheet supporting surface 24 of the stationary platen for removing moisture released by heated sheets and by heated ink images, from an area immediately above the sheet supporting surface 24.

The method of the present invention for printing unmottled, high quality multicolor liquid ink images on plain paper comprises the steps of heating a flat stationary platen 24 having a first long side 14, a second long side 16, a first short end 18 and a second short end 20, and a sheet supporting surface 24 for supporting and heating a sheet of plain paper, and feeding onto the heated stationary platen 12, a sheet 26, 28 of plain paper long edge first from a sheet containing and feeding assembly 34 that is mounted along the first long side 14 of the stationary platen. The method next includes the steps of moving sheet drive rollers 42 over, and to about a center of a sheet of plain paper being supported on the stationary platen, and driving the sheet of plain paper onto the platen and against an articulating sheet registration guide on the stationary platen for registration.

The method then includes the steps of applying electrostatic charges onto the registered sheet of plain paper for electrostatically holding it down onto the stationary platen, and then bidirectionally moving a sheet driving and printing assembly 36 for moving a plurality of full width array printheads 44A–44D, each containing a different color liquid ink, back and forth between the first and the second short ends 18, 20 respectively, and relative to the held down registered sheet of plain paper, for selectively printing with one of the plurality of full width array printheads on each back and each forth movement of the plurality of full width array printheads between the first and second short ends 18, 20, thereby producing an unmottled, high quality multicolor liquid image on the plain paper.

The method also includes a step of delaying for about a second after each printing movement, a subsequent movement of the sheet driving and printing assembly 36, and hence printing of each of the plurality of full width array printheads. The method further includes a step of moving the sheet drive rollers 42 over, and to about a center of a printed sheet, and driving the printed sheet therewith off of the platen 12 into an output tray 48.

Thus, it is preferable to heat the substrate, move the sheet moving and printing assembly in accordance with the present invention, delay the time between printing with slow dry black ink and fast dry color ink, use checkerboard (or the equivalent) printing which requires two passes of the paper by the printhead, and laterally shift the full width printhead between print passes to minimize printhead signature.

Figure 3:
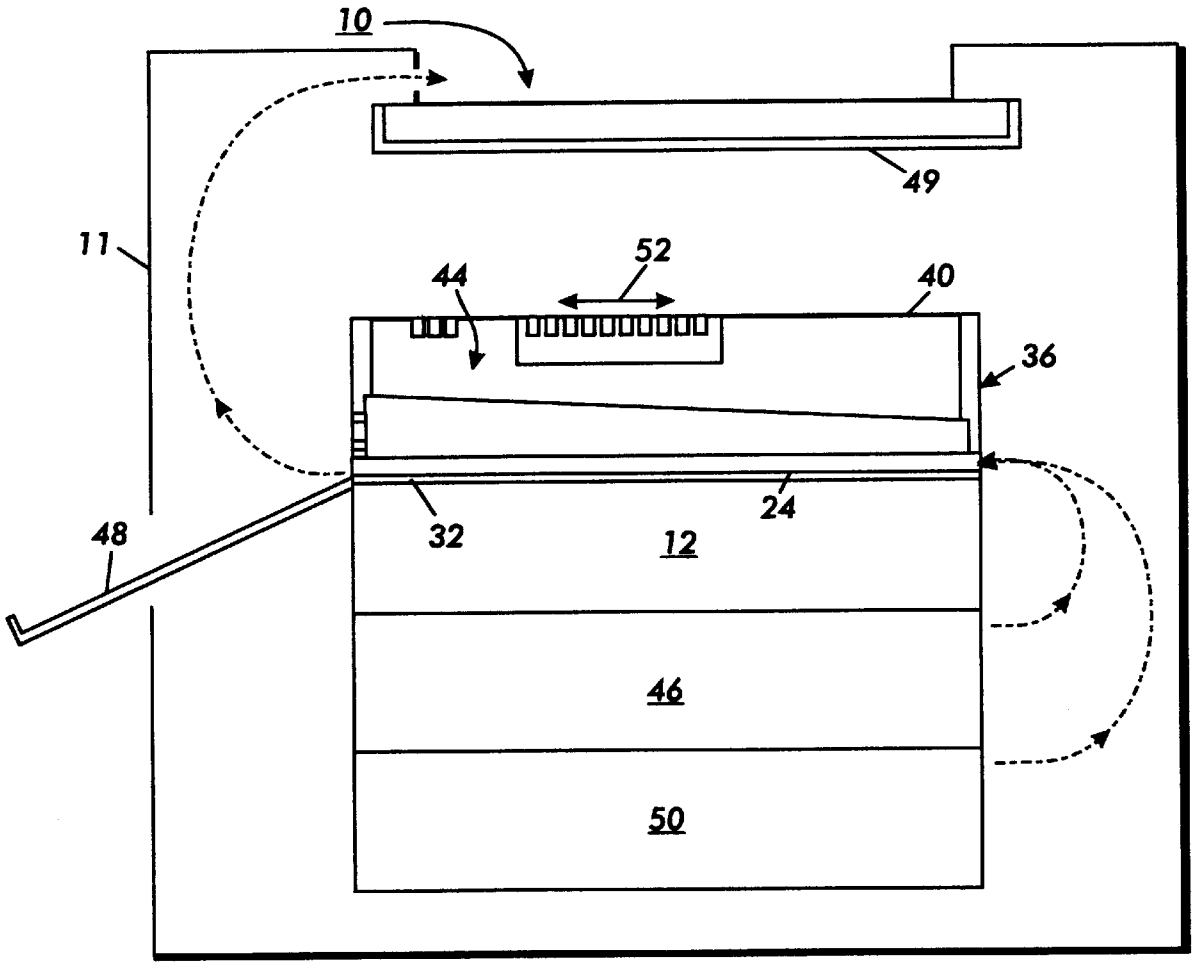
FIG. 3 is a vertical end schematic of a second embodiment of an ink jet printing apparatus for printing unmottled, high quality liquid ink images in accordance with the present invention.

In the FIG. 3 embodiment, the sheet containing and feeding assembly 34 comprises two (500 sheet capacity) input trays 46, 50 for feeding sheets long edge first as shown. The sheet containing input trays 46, 50 are located to the bottom of the platen 12, and can be expanded to a larger capacity base. An output tray 48 is located to the side, and another one 49 may be located on top of the platen as shown for human factors reasons. For duplexing using the embodiment of FIG. 3, the sheet or paper must be turned over and printed on from bottom to top. The paper is turned around for example by feeding it into a slot below the bottom input tray 50, and then brought back up and deposited face up in the top input tray 46. The image is inverted electronically. The output tray 48 when located on top of the platen, moves up, the carriage device 40 moves to the far end of the travel, and the input trays each can then slide open up for ready access to the paper path for jammed printers.

To operate the printer 10, a substrate or sheet is fed in the direction of the arrows 72, 74 (FIG. 1) from an input tray 46 on demand, and long edge first until it is at least 3" onto the substrate supporting surface 24 of the heated platen 12. The carriage device 40 is moved so that it locates the sheet drive rollers 42 at about a center of such sheet for moving the sheet fully onto the surface 24 and against the corner edge registration guide 54. As the carriage device is then moved off the sheet, the charging device 56 applies a layer of charge onto the sheet, thereby tacking and holding it down onto the surface 24. Such charge application and tacking down is preferably also done on the first printing pass.

For printing, the printheads 44A–44D on the carriage device 40 are each fired off using a film encoder (not shown). The printheads 44A–44D advantageously print in both directions of movement of the carriage device 40, which for heat and delay printing (as discussed above) will hesitate between movements, if necessary. Single ink printing and multicolor ink printing are each carried out in the same manner, for example using suitable delays. Any combination of printing and between movement delay times can be used. In addition, checkerboard printing as disclosed for example in U.S. Pat. No. 4,748,453 issued to Lin et al, preferably is also used on the heated sheet or paper in order to minimize paper cockle to a point where the sheet or paper can be effectively held down electrostatically on the substrate supporting surface 24, and be printed on repeatedly In any case, when desired printing is completed, the carriage device 40 moves the drive rollers 42 back over the printed sheet for driving the sheet off of the platen and into the output tray. Sheets may tend to take a "set" from the surface 24 while on the heated platen, and so will most likely stay flat on being driven off. However, if necessary, the sheet should be driven as such through a decurler (not shown) and into the output tray. Note that the decurler in this case is decurling the sheet from a normal curl that it takes after being printed on. When a decurler is to be used, it is located between the platen 12 and the output tray 48.

As can be seen, there has been provided a multicolor liquid ink printer for printing unmottled, high quality images on sheets of plain paper. The multicolor liquid ink printer includes a flat, generally rectangular stationary platen having a first long side, a second long side, a first short end, a second short end, and a sheet supporting surface for supporting a sheet of plain paper. The multicolor liquid ink printer also includes a heating device for heating the stationary platen, and a sheet containing and feeding assembly for containing and feeding sheets of plain paper onto the sheet supporting surface of the stationary platen. Importantly, the multicolor liquid ink printer includes a bidirectionally movable sheet driving and printing assembly that is movable over and relative to the stationary platen and to a sheet being supported on the stationary platen. The sheet driving and printing assembly includes (i) a carriage; (ii) drive rollers mounted to the carriage for driving and moving a sheet on the stationary platen relative to the stationary platen, and (iii) a plurality of full width array printheads mounted to the carriage. Each full width array printhead of the plurality of full width array printheads contains a different color liquid ink for printing an unmottled, high quality liquid ink image onto a sheet of plain paper that is stationarily supported on the flat platen, thereby together forming an unmottled, high quality multicolor liquid ink image on the plain paper. As described herein, the liquid ink printing apparatus of the present invention is preferably a flat platen thermal ink jet printer that is capable of producing unmottled, high quality multicolor images on plain paper.

While this invention has been described in conjunction with specific embodiments thereof, it is evident that many alternatives, modifications and variations will be apparent to those skilled in the art. Accordingly, it is intended to embrace all such alternatives, modifications, and variations as fall within the spirit and broad scope of the appended claims.

What is claimed is:

1. A multicolor liquid ink printer for printing on sheets of plain paper, comprising:

(a) a flat stationary platen having a sheet supporting surface for supporting a sheet of plain paper, said stationary platen being generally rectangular including a first long side, a second long side, a first short end, and a second short end;

(b) a heating device for heating said stationary platen;

(c) a sheet containing and feeding assembly for containing and feeding sheets of plain paper onto said sheet supporting surface of said stationary platen; and (d) a bidirectionally movable sheet driving and printing assembly being movable over and relative to said stationary platen and to a sheet being supported on said stationary platen, said sheet driving and printing assembly including (i) a carriage device; (ii) drive rollers mounted to said carriage device for driving and moving a sheet on said stationary platen relative to said stationary platen, and (iii) a plurality of full width array printheads mounted to said carriage device, each full width array printhead of said plurality of full width array printheads containing a different color liquid ink for printing an unmottled, high quality liquid ink image onto a sheet of plain paper stationarily supported on said flat platen, thereby together forming an unmottled, high quality multicolor liquid ink image on said plain paper.

2. The multicolor liquid ink printer of claim 1, including an articulating sheet registration guide mounted at a corner of said stationary platen between a long side and a short end adjoining the long side, of said stationary platen.

3. The multicolor liquid ink printer of claim 1, wherein said heating device is a foil heater located within said flat platen.

4. The multicolor liquid ink printer of claim 1, including a heat insulating shield mounted movably over said platen, said heat insulating shield being movable towards and away from said sheet supporting surface of said stationary platen.

5. The multicolor liquid printer of claim 4, where said heat insulating shield is lowered down onto said substrate supporting surface for covering and insulating said substrate supporting surface during an idle period between printing operations.

6. The multicolor liquid ink printer of claim 1, wherein said sheet containing and feeding assembly includes a sheet tray and a feed head mounted to said first long side of said stationary platen for feeding sheets long edge first onto said stationary platen.

7. The multicolor liquid ink printer of claim 1, including a charging device selectively producing electrostatic charge for electrostatically holding down a sheet of paper onto said sheet supporting surface.

8. The multicolor liquid ink printer of claim 7, wherein said charging device is mounted to said carriage of said sheet driving and printing assembly for driving therewith relative to said stationary platen and to a sheet of paper on said stationary platen.

9. The multicolor liquid ink printer of claim 1, wherein said bidirectionally movable sheet driving and printing assembly is mounted within the liquid ink printer for moving back and forth between said first short end and said second short end of said stationary platen.

10. The multicolor liquid ink printer of claim 1, wherein each full width array printhead of said plurality of full width array printheads has a long axis and is shiftable along said long axis for preventing printhead signature defects in a printed image.

11. The multicolor liquid ink printer of claim 1, including a first spit station at said first short end, and a second spit station at said second short end, for purging each full width array printhead of said plurality of full width array printheads between successive printing movements of said bidirectionally movable sheet driving and printing assembly.

12. The multicolor liquid ink printer of claim 1, including a maintenance station located at said first short end of said stationary platen for maintaining each full width array printhead of said plurality of full width array printheads, said maintenance station including:

(a) a wet wiper member for applying a wetting liquid to nozzles of each full width array printhead at said maintenance station;

(b) a vacuum priming device for applying a vacuum suction force to wet nozzles of each full width array printhead; and (c) a capping member for capping nozzles of each full width array printhead during long idle periods of the printer.

13. A method of liquid ink printing of unmottled, high quality multicolor images on plain paper, the method comprising the steps of:

(a) heating a flat stationary platen having a first long side, a second long side, a first short end and a second short end, and a sheet supporting surface for supporting and heating a sheet of plain paper;

(b) feeding onto the heated stationary platen, a sheet of plain paper along edge first from a sheet containing and feeding assembly mounted along the first long side of the stationary platen;

(c) moving a sheet drive roller, which is mounted onto a carriage device, over, and to about a center of a sheet of plain paper being supported on the stationary platen;

(d) driving the sheet of plain paper on the platen and against an articulating sheet registration guide on the stationary platen for registration, by using the sheet drive roller;

(e) applying electrostatic charges onto the registered sheet of plain paper for electrostatically holding it down onto the stationary platen; and (f) bidirectionally driving a plurality of full width array printheads mounted on said carriage device and each containing a different color liquid ink, back and forth between the first and the second short ends of the stationary platen, and relative to the held down registered sheet of plain paper, for selectively printing with a full width array of the plurality of full width array printheads on each back and each forth movement of the plurality of full width away printheads between the first and second short ends, thereby producing an unmottled, high quality multicolor liquid image on the registered plain paper.

14. The method of claim 13, including a step of delaying a subsequent printing movement of each of the plurality of full width array printheads for about a second after each printing movement.

15. The method of claim 13, including a step of moving the sheet drive roller over, and to a center of a printed sheet, and driving the printed sheet therewith into an output tray.

* * * * *